US011333331B2

(12) United States Patent
Hale et al.

(10) Patent No.: US 11,333,331 B2
(45) Date of Patent: May 17, 2022

(54) FOLDABLE LIGHTED SPHERE

(71) Applicant: Wintergreen Corporation, Alpharetta, GA (US)

(72) Inventors: William Hale, Cumming, GA (US); Frank Skinner, Woodstock, GA (US)

(73) Assignee: Wintergreen corporation, Alpharetta, GA (US)

( * ) Notice: Subject to any disclaimer, the term of this patent is extended or adjusted under 35 U.S.C. 154(b) by 0 days.

(21) Appl. No.: 17/244,412

(22) Filed: Apr. 29, 2021

(65) Prior Publication Data

US 2021/0341135 A1 Nov. 4, 2021

Related U.S. Application Data

(60) Provisional application No. 63/017,074, filed on Apr. 29, 2020.

(51) Int. Cl.

| | |
|---|---|
| ***F21V 3/02*** | (2006.01) |
| ***F21V 21/00*** | (2006.01) |
| ***F21V 1/06*** | (2006.01) |
| *F21Y 107/20* | (2016.01) |

(52) U.S. Cl.
CPC ..... *F21V 21/00* (2013.01); *F21V 1/06* (2013.01); *F21V 3/023* (2013.01); *F21Y 2107/20* (2016.08)

(58) Field of Classification Search
CPC ..... F21V 1/06; F21V 3/023
See application file for complete search history.

(56) References Cited

U.S. PATENT DOCUMENTS

| | | | |
|---|---|---|---|
| 5,876,111 | A | 3/1999 | Wu |
| 6,401,404 | B1 | 6/2002 | Fillipp et al. |
| 6,419,373 | B1 | 7/2002 | Sheih |
| 6,474,843 | B2 | 11/2002 | Sheih |
| 8,764,234 | B1 | 7/2014 | Acree et al. |
| 10,161,601 | B1 * | 12/2018 | Chen ..... F21V 17/007 |
| 10,161,602 | B1 | 12/2018 | Bleile |
| 2002/0141184 | A1 | 10/2002 | Sheih |

* cited by examiner

*Primary Examiner* — Sean P Gramling
(74) *Attorney, Agent, or Firm* — FisherBroyles, LLP; Rachel Huffstetler

(57) ABSTRACT

A foldable, three-dimensional structure, such as a sphere, which is lighted to provide a decorative display. The sphere includes a clean-lined display defined by collapsible lighted frame ribs. The frame ribs rotate about the central support to achieve a compact position for improved storage and shipping.

11 Claims, 9 Drawing Sheets

FOLDABLE LIGHTED SPHERE

CROSS REFERENCE TO RELATED APPLICATION

This application claims priority to U.S. Provisional Application No. 63/017,074 filed Apr. 29, 2020, the disclosure of which is hereby incorporated by reference.

FIELD OF THE INVENTION

The present invention is generally directed to a foldable, three-dimensional structure, such as a sphere, which is lighted to provide a decorative display. More specifically, the sphere includes a clean-lined display defined by collapsible lighted frame ribs. The frame ribs rotate about the central support to achieve a compact position for improved storage and shipping.

BACKGROUND OF THE INVENTION

A conventional lighted three-dimensional structure, such as a sphere, is a solid structure which is cumbersome to store and expensive to ship. Earlier attempts at providing a foldable sphere provide a sphere with an intricate frame with numerous members extending from the center support to the lighted ribs, thus detracting from the aesthetics of the structure. Other attempts include providing two sided spheres wherein one side is inverted and nested within the other half which only reduces the sphere size by half. Moreover, prior art attempts at minimizing the size of a lighted sphere fail to achieve sufficient compactness to achieve shipping and storage benefits.

SUMMARY OF THE INVENTION

It is, therefore, advantageous for a foldable lighted structure, such as a sphere, to achieve a compact, folded position while resulting in an aesthetically pleasing, open frame design.

The present invention overcomes shortcomings of the prior art by providing a lighted three-dimensional structure for decorative illumination, such as a sphere with a clean-lined, open (that is, unobstructed interior) novel structure. The sphere interior can include additional decorative features or remain open. The sphere includes a top cap and a bottom cap, radiating ribs extending therebetween, and a rib longitudinal center support. A plurality of ribs extend between the top and bottom caps and are generally arcuate, for a spherical structure by way of example, forming the outer configuration. Lights are positioned along the length of the ribs to illuminate the sphere. The sphere, according to various aspects of the invention, may be folded wherein the ribs of each side of the sphere converge to a compact position, such as rotating about the center support and one folded side rests upon or nests within the opposing compacted side. These and other objectives are met by the present invention.

DETAILED DESCRIPTION OF THE INVENTION

The present invention will now be described in detail hereinafter by reference to the accompanying drawings. The invention is not intended to be limited to the embodiments described; rather, this detailed description is provided to enable any person skilled in the art to make and practice the invention.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue As used herein, the terms "top" and "bottom" are used to refer to the axial ends of the lighted sphere and are interchangeable or reversable. Also, as used herein, the "radial direction" refers to a direction which intersects the longitudinal axis, at any angle. The description and drawings refer to a spherical three-dimensional structure for the sake of discussion only, as any three-dimensional geometric configuration are within the scope of the presently disclosed invention. It is also envisioned that a non-symmetric configuration is within the scope of the presently disclosed invention.

Figure 1:
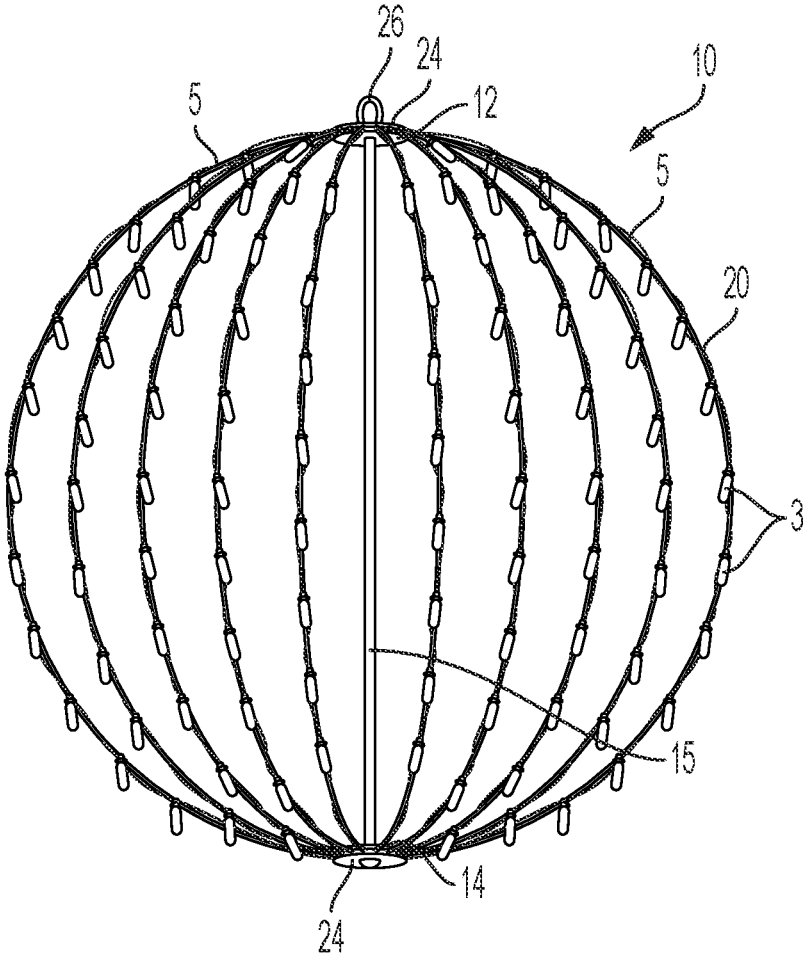
FIG. 1 is a perspective view of the lighted sphere in a first, display position according to one aspect of the present invention.

As shown in the Figures, the sphere 10 includes two hemispheres 5, such as a first and second hemisphere, for example, right and left (but could also be top and bottom) hemispheres as shown in FIG. 1. Each hemisphere 5 includes a top cap 12, bottom cap 14 and according to a first embodiment, a center support 15 extending therebetween. It is within the scope of the invention, however, to provide ribs 20 of sufficient rigidity wherein a center support 15 is unnecessary. Also, as described below, a separate center support 15, not secured to a respective hemisphere, may be provided according to another aspect of invention. At least one, or as shown, a plurality of ribs 20 extend radially outwardly between the top cap 12 and the bottom cap 14. The ribs 20 are arcuate in side elevation wherein a plurality of such ribs 20 define the overall spherical configuration as shown in FIG. 1 when the sphere is in a first, display position. The lights 3, shown in FIG. 1, are applied to the ribs such as a string light wherein the wire is wrapped around the ribs 20.

Figure 2:
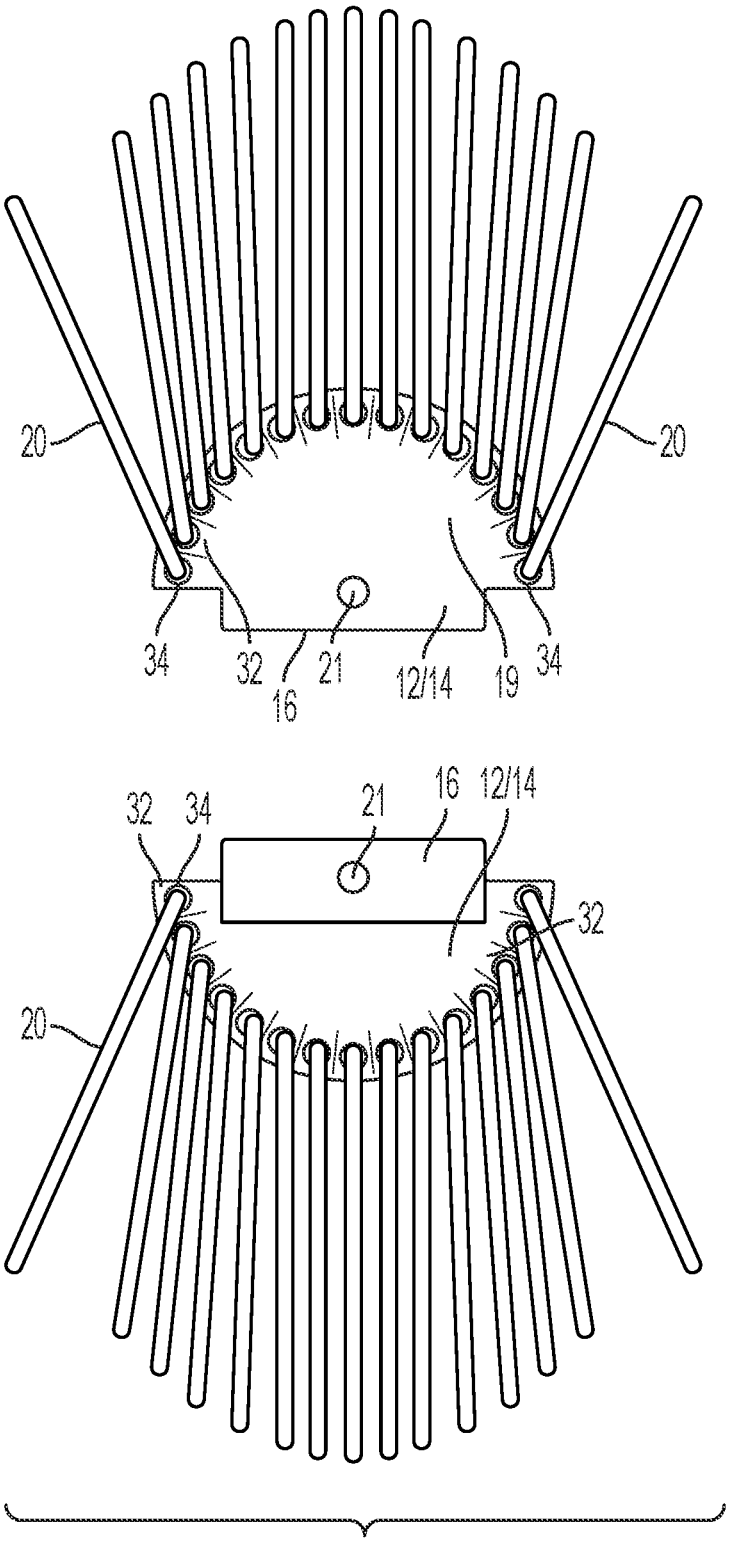
FIG. 2 is a top plan of mating top caps of two hemispheres according to one aspect of the invention.
Figure 7A:
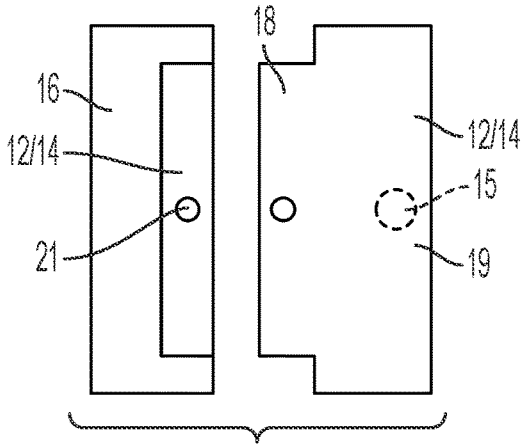
FIGS. 7A and 7B are plan views of the top plates of adjacent hemispheres according to one aspect of the present invention in an unmated and mated position, respectively.
Figure 7B:
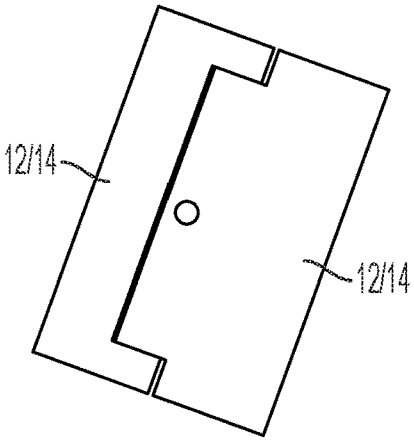

As best illustrated in FIGS. 2 and 7A and 7B, either or both of the top caps 12 and bottom caps 14 of each hemisphere 5 are matingly configured according to one aspect of the invention. One top cap 12 and, as shown, also the bottom cap 14, defines a recessed seat 16 configured to receive the mating top cap 12, such as, a flange 18. As shown, in FIG. 2 flange 18 extends beyond the edge of top cap main body portion 19, but, as shown in FIG. 7B, the main body portion 19 may be received by the recessed seat 16. As shown in FIG. 4, the top caps 12 of juxta positioned hemispheres 5 mate to facilitate the formation of a sphere (it is noted that the securing member 23 is not shown in FIGS. 3, 4 and 5 for illustrative purposes).

The top cap 12 and bottom cap 14 define an aperture 21 which, when mated, are in alignment for receipt of a securing member 23, such as a screw as shown. Each hemisphere 5 includes a center support 15 as shown in the various figures. As shown, the center support 15 of the hemisphere including the recessed seat 16 is generally in alignment with the respective aperture 21 of the top cap 12 and bottom cap 14. A threaded portion 22 is defined therein for mating receipt of the securing member 23. Of course, this may be reversed wherein the center support 15 of the hemisphere with the flange 18 may be aligned with the respective aperture 21 and the threaded portion 22 defined thereby. Alternatively, the threaded portion 22 may be a separate member, such as a nut, and neither center support 15 defines the threaded portion 22. And in any of these aspects of the present invention, the threaded portion 22 is also defined by the bottom cap 14 and/or respective center support 15.

Figure 5:
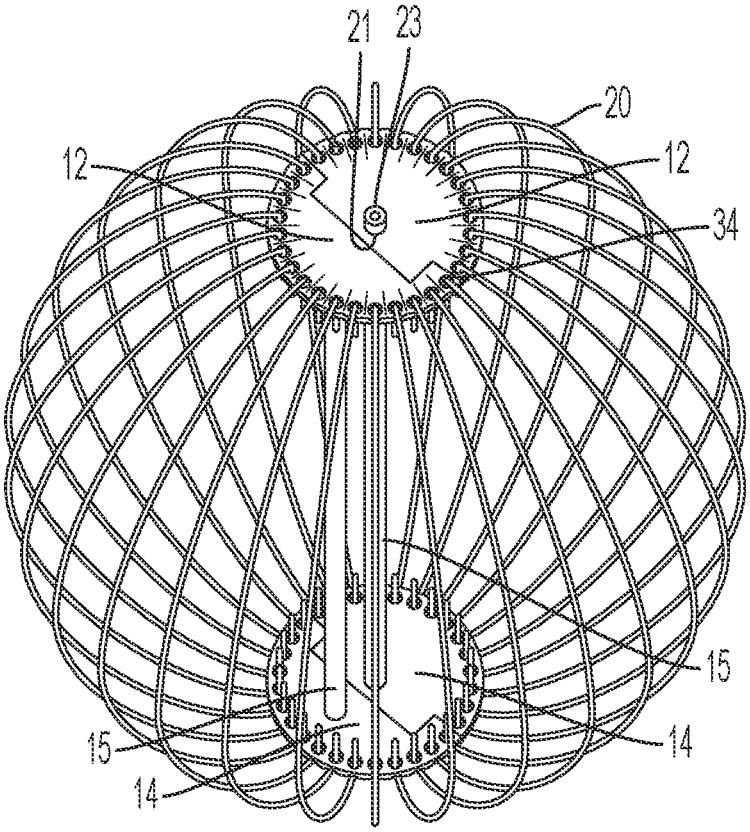
FIG. 5 is a perspective view of FIG. 2 with the ribs in the first, display position.
Figure 6:
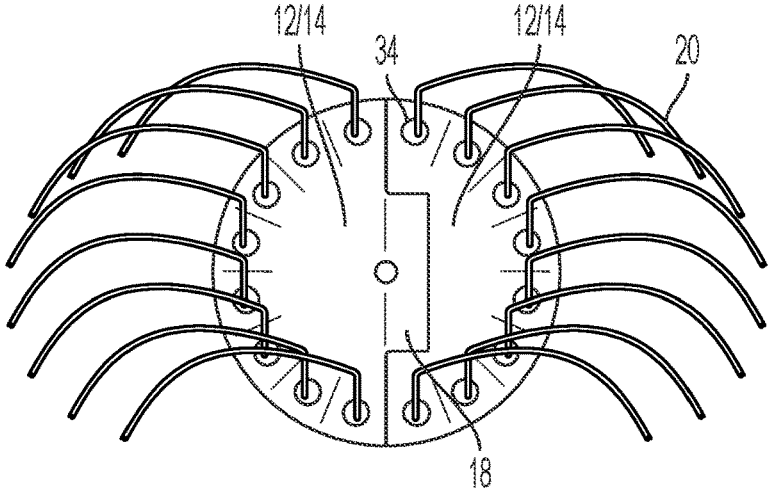
FIG. 6 is an enlarged view of the top cap and ribs partially removed according to one aspect of the present invention.
Figure 7C:
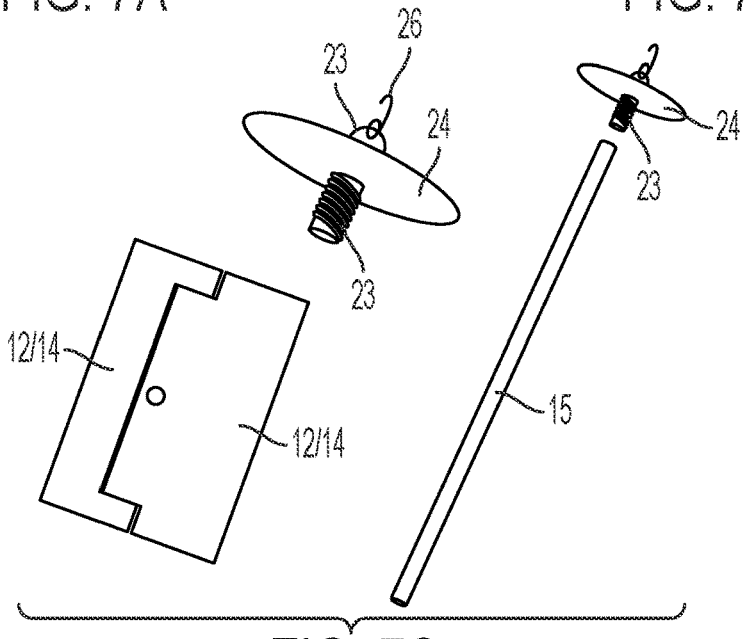
FIG. 7C is an exploded view of the securing member and top plates according to one aspect of the present invention.
Figure 8A:
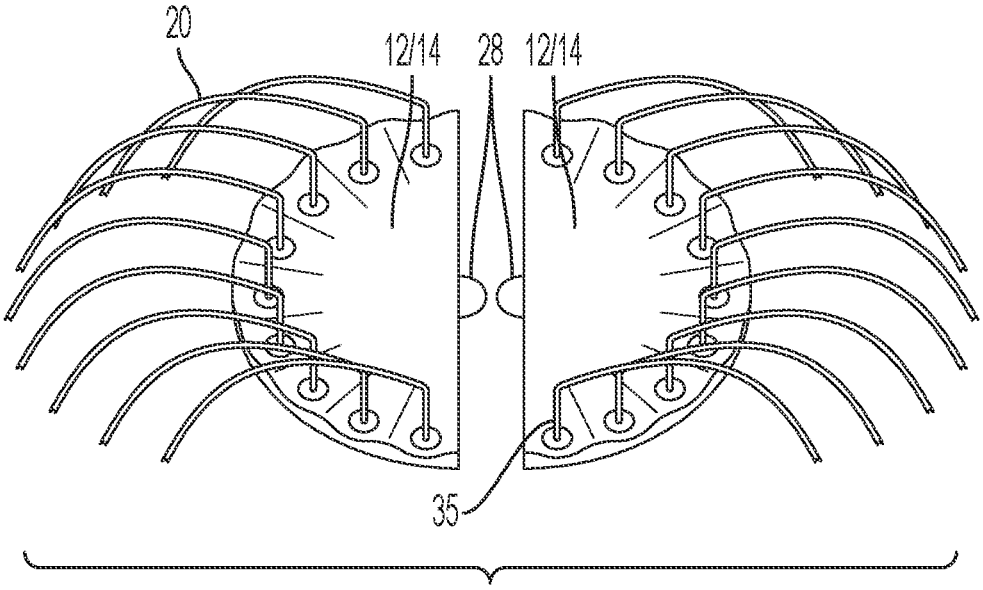
FIG. 8A is a top plan view of the rib plates disengaged according to another aspect of the present invention.
Figure 8B:
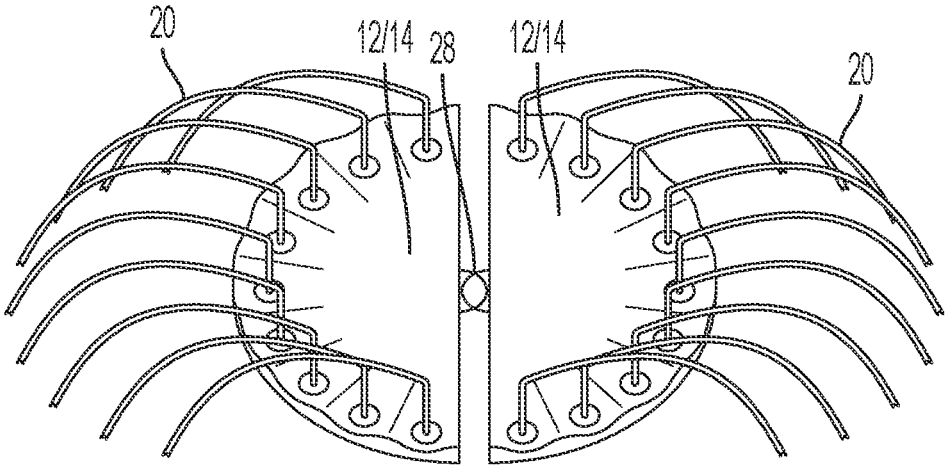
FIG. 8B is a top plan view of the rib plates substantially engaged according to the aspect of the invention of FIG. 8A.
Figure 9:
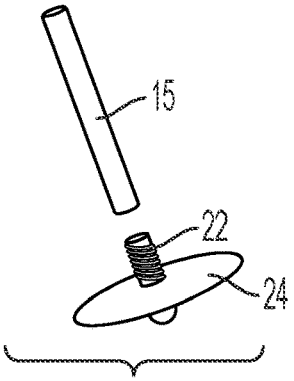
FIG. 9 is an enlarged view of the center rod according to one aspect of the present invention.

The top cap 12 as shown is generally a half circle wherein the adjoined top caps 12 form a substantial circle. The top cap 12 defines at least one, or a plurality of rib receiving apertures 34 which, as shown, are positioned adjacent and circumferentially around the top cap 12 outer edge. The top cap 12 may be substantially flat along its outer edge, or may define spaced apart concave seats 32 which, as shown, are defined by an outer edge 30 which is generally sinusoidal when viewed in side elevation with spaced apart concave seats 32 as shown in FIG. 6. The seats 32 are configured for receipt of at least rib 20 or a respective one of the seats 32. Each rib 20 includes at least one end, and preferably a top and bottom end, to mate with at least one of the top 12 or bottom 14 caps, and preferably both the top 12 and bottom 14 cap. The mating end of the rib 20, as illustrated in FIGS. 5-7, includes a bent end 35 which extends into and through the rib plate aperture 34 and which sits within the seat 32. Accordingly, the ribs 20 may be selectively positioned along the top 12 and bottom plates 14 uniformly or non-uniformly, one rib within each seat 32 or more than one rib 20 within a seat 32, a non-uniform number of ribs within various seats 32, or the ribs 20 positioned outside of a seat 32. The ribs 20 may thus be moved to achieve various configurations. The ribs 20 rotate when the rib end 35 is positioned within the aperture 34 such as shown in FIG. 6 wherein the two front most ribs shown are not seated with a seat 32.

With the ribs 20 in position, a securing plate 24, is provided to secure the selected rib 20 positions. The securing plate 24 is positioned above the ribs 20 within apertures 21 and concave portions of the top 12 and bottom 14 plates to secure the ribs 20 in position.

A tightening member or screw 23 is used to secure the securing plate 24 as described above. The securing plate 24 includes a handle 26 which may be of variable configurations but, which as shown, is a semi-circle which is rotated by the user to advance the threaded portion 23 of the securing plate 24 into the threaded portion or cavity 22 of the center support 15 to secure the securing plate 24. When tightened on the center support 15, the securing plate 24 maintains the selected position of the ribs 20 preventing further movement after it is secured.

Figure 3:
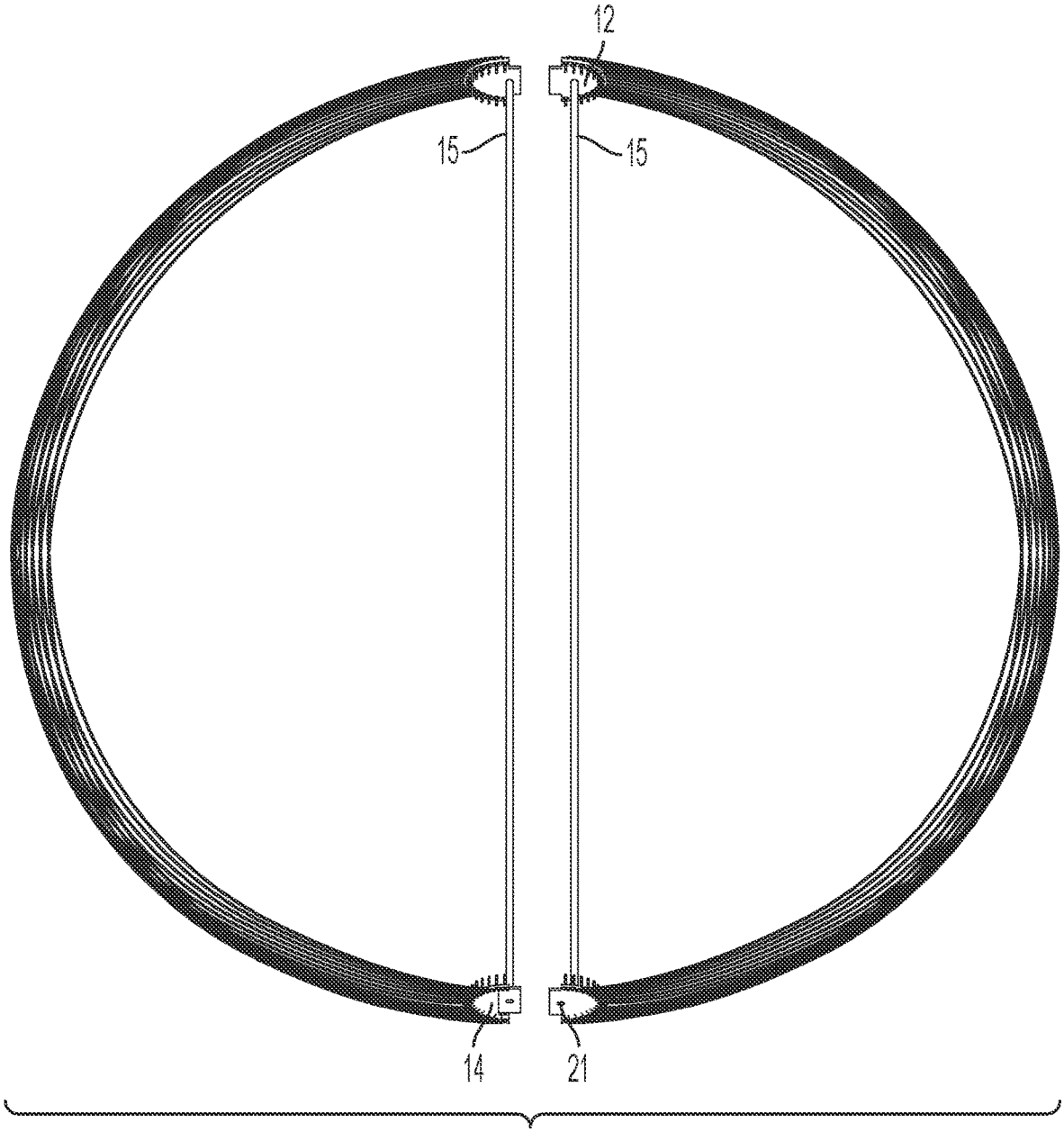
FIG. 3 is a side elevation view of both hemispheres according to FIG. 2 with the ribs in a second, collapsed position.
Figure 4:
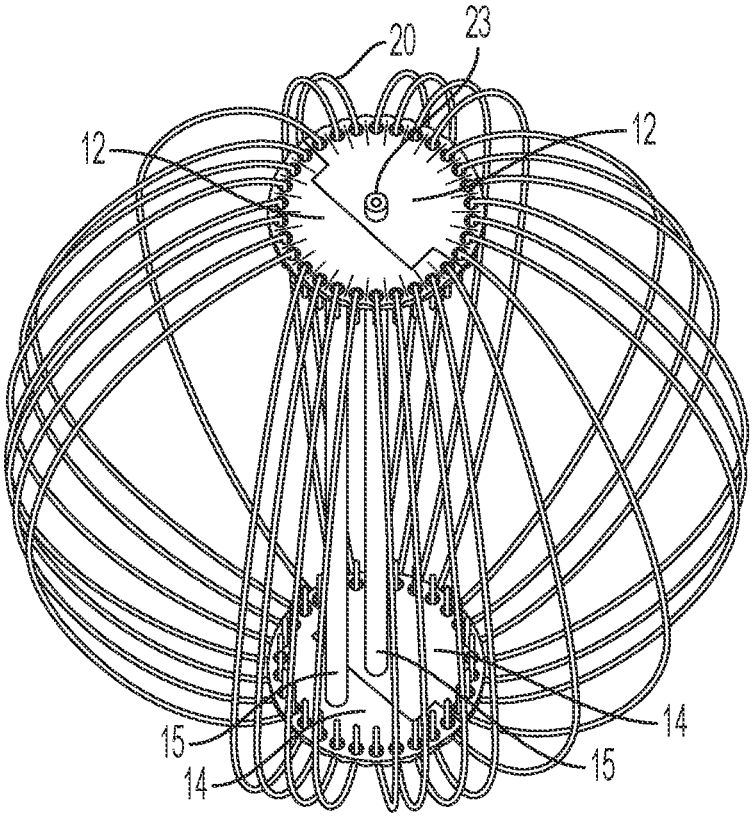
FIG. 4 is a perspective view of FIG. 2 with the ribs in a partially collapsed position.

The method of collapsing and displaying the lighted sphere 10 according to FIGS. 1-7 includes applying the ribs 20 to the top 12 and bottom 14 plates by inserting the bent ends 35 of the ribs 20 into a respective rib receiving aperture 34. Once the ribs 20 are inserted into the top 12 and bottom caps 14, they may be folded or collapsed as shown in FIG. 3 for storage, transport, or the like. The ribs 20 are pivotally supported by the top 12 and bottom 14 caps and may then be spread out to form the desired geometric configuration. The securing plates 24 are then applied to the top 12 and bottom 14 caps and the securing member 23 or screw is inserted through the aperture on the securing plate 24 and through the top 12 and bottom 14 caps and the screw 23 is tightened.

According to another aspect of the present invention as shown in FIG. 8-13, one center support 15 is provided and includes a threaded portion 22 on either the top end adjacent the top cap 12 or the bottom end adjacent the bottom cap 14 and, preferably, on both ends. As shown in FIGS. 8-13, the top cap 12 and bottom cap 14 are differently configured and a separate center support 15 (that is, not integral to one set of top 12 and bottom caps 14 of one hemisphere 5). The top cap 12 and bottom cap 14 define members 28 which are configured to mate with the threaded ends of the center support 15. As shown, the center support 15 defines a threaded cavity 22 and the top 12 and bottom 14 caps define a threaded extension or screw 23 which is configured to be received by the threaded cavity 22. Of course, this may be reversed wherein the caps 12, 14 define a cavity and the center rod 15 defines a threaded extension. According to another aspect of the present invention, no center support is provided and the top cap 12 and bottom cap 14 mate to a fastening member (not shown) such as a nut or the like.

As shown in FIGS. 8-13, the top 12 and bottom 14 plates each include a mating member in the form of a ring 28 which are configured to overlap with one another and to receive the center support 15. As shown in FIGS. 6 and 7, the rings 28 are placed on the center support 15, or other fastening member, in an overlapping positioning wherein the bottom surfaces of each plate contact an end portion of the center support 15. Thus, tightening of the securing member 23 secures the securing plate 24 in position on the center support 15. As shown in FIGS. 8A-8B, before the securing plate 24 is secured to the center support 15 or when the securing plate 24 is loosened for repositioning, the ribs 20 may be rotated to assume various positions.

Figure 10:
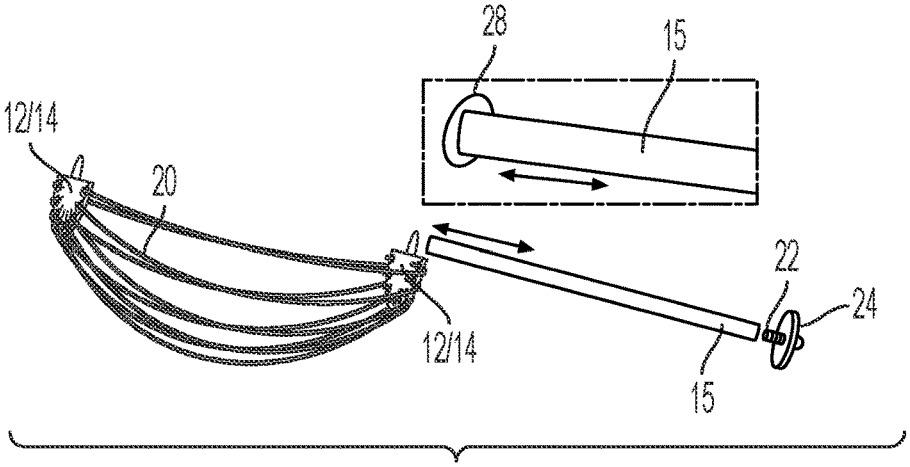
FIGS. 10, 11, 12 and 13 illustrate sequential steps of assembling one aspect of the present invention.
Figure 11:
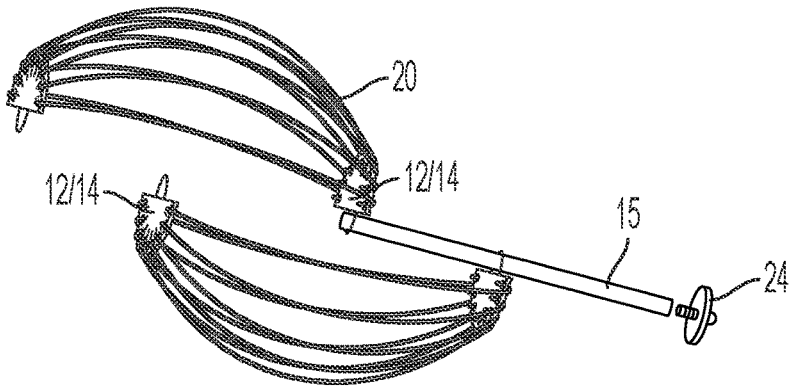
Figure 12:
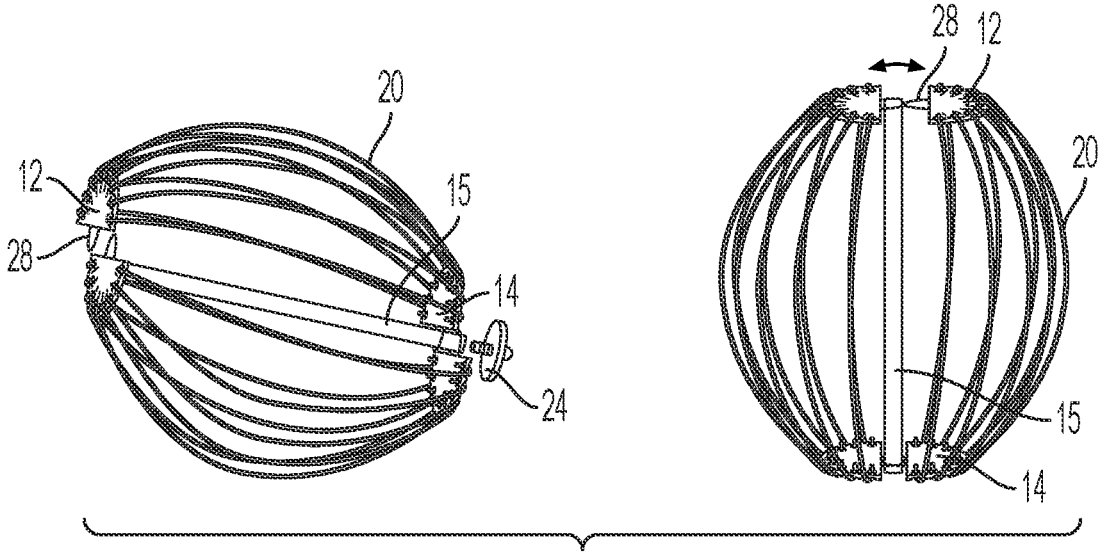
Figure 13:
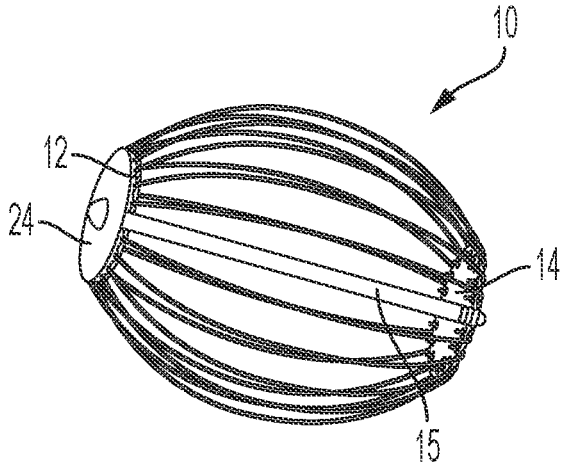

The method of assembly and collapsing of the lighted sphere 10 as shown in FIGS. 9-13 according to one aspect of the invention. The bottom cap 14 is positioned on the center support 15. The bottom ring 28 of one bottom cap 14 is positioned onto and slid along the center support 15 as shown in FIG. 10. The bottom ring 28 of the second rib plate is likewise positioned on the center support 15 as shown in FIG. 11. The top ring 28 of the first applied hemisphere 5 is then positioned on the center support 15 and then the ring 28 of the second hemisphere 5 as shown in FIG. 12. As shown in FIG. 13, once both the first and second top 12 and bottom caps 14 are on the center rod 15, the securing plate 24 is applied to the center support 15 and before the securing member 23 is tightened, the ribs 20 may be rotated from a second compact position shown in FIG. 12, top illustration, to a first displayed position shown in the bottom image of FIG. 12. Once the ribs 20 are positioned, the securing member 23 is tightened to maintain the displayed position.

While exemplary embodiments have been shown and described above for the purpose of disclosure, modifications to the disclosed embodiments may occur to those skilled in the art. The disclosure, therefore, is not limited to the above precise embodiments and that changes may be made without departing from its spirit and scope.

What is claimed is:

1. A collapsible lighted sphere which is moveable between a first displayed position to a second compact position comprising:

a first and second hemisphere wherein each hemisphere respectively comprises a first and second top cap each having an outer edge and defining a plurality of apertures adjacent said top cap outer edge wherein said first top cap includes a first top cap main body portion and a first top cap flange and said second top cap includes a second top cap recessed seat configured for receipt of said first top cap flange when said first and second top caps are mated;

wherein said first and second hemisphere each comprises, respectively, a first and second bottom cap each having an outer edge and defining a plurality of apertures adjacent said bottom cap outer edge wherein said first bottom cap includes a first bottom cap main body portion and a first bottom cap flange and said second bottom cap includes a second bottom cap recessed seat configured for receipt of said first bottom cap flange when said first and second bottom caps are mated;

a plurality of ribs, each rib having a top end extending through a respective one of said top cap apertures and a bottom end extending through a respective one of said bottom cap apertures wherein said plurality of ribs are pivotally connected to said top and bottom caps to move from said second compact position to said first displayed position; and a first and second securing plate and respective first and second securing members wherein said first securing plate is positioned on said first and second top caps when mated and said plurality of ribs have been positioned in said first displayed position and said first securing member extends through said first securing plate and said first and second top caps to secure said plurality of ribs and wherein said second securing plate is positioned on said first and second bottom caps when said plurality of ribs have been positioned in said first displayed position and said second securing member extends through said second securing plate and said first and second top caps to secure said plurality of ribs.

2. The collapsible lighted sphere according to claim 1 further comprising a first and second mating member for mating with said first and second securing members to secure said first and second securing plates wherein said first and second mating members are positioned on an inner surface of said lighted sphere and said first and second securing members are positioned on an outer side surface of said lighted sphere.

3. The collapsible lighted sphere according to claim 2 further comprising at least one center support defining said first and second mating members for mating with said first and second securing members.

4. The collapsible lighted sphere according to claim 3 wherein said at least one center support defines a threaded cavity on a top and bottom end configured for receipt of one of said first and second securing members.

5. The collapsible lighted sphere according to claim 4 wherein said first and second securing members are threaded.

6. The collapsible lighted sphere according to claim 1 wherein said first hemisphere comprises a first center support and said second hemisphere comprises a second center support wherein said first center support extends between said first top cap and said first bottom cap and said second centers support extends from said second top cap to said second bottom cap.

7. The collapsible lighted sphere according to claim 6 further comprising a first and second mating member for mating, respectively, with said first and second securing members to secure said first and second securing plates.

8. The collapsible lighted sphere according to claim 7 wherein said first center support includes said first mating member on a top end and said second mating member on its bottom end for mating with said first and second securing members to secure said first and second securing plates to said first and second top and bottom caps.

9. The collapsible lighted sphere according to claim 1 wherein said plurality of ribs support a plurality of lights.

10. The collapsible lighted sphere according to claim 1 wherein said top and bottom ends of each of said plurality of ribs is a bent end for pivotally connecting to said first and second top and bottom caps.

11. The collapsible lighted sphere according to claim 1 wherein said first and second top and bottom caps define a plurality of depressions adjacent said outer edges and wherein said plurality of apertures are each positioned within a respective one of said plurality of depressions.

* * * * *